US005592121A

United States Patent [19]

Jung et al.

[11] Patent Number: 5,592,121

[45] Date of Patent: Jan. 7, 1997

[54] INTERNAL POWER-SUPPLY VOLTAGE SUPPLIER OF SEMICONDUCTOR INTEGRATED CIRCUIT

[75] Inventors: Chul-Min Jung, Seoul; Hee-Choul Park, Suwon, both of Rep. of Korea

[73] Assignee: Samsung Electronics Co., Ltd., Suwon, Rep. of Korea

[21] Appl. No.: 358,929

[22] Filed: Dec. 19, 1994

[30] Foreign Application Priority Data

Dec. 18, 1993 [KR] Rep. of Korea ..... 1993-28363

[51] Int. Cl.[6] ..... G05F 1/46

[52] U.S. Cl. ..... 327/541; 327/538; 327/542; 323/314

[58] Field of Search ..... 327/538, 541, 327/545, 546, 543, 540, 542, 143, 220, 539; 323/313, 314, 315, 316

[56] References Cited

U.S. PATENT DOCUMENTS

| | | | |
|---|---|---|---|
| 5,061,862 | 10/1991 | Tamagawa | 327/541 |
| 5,077,518 | 12/1991 | Han | 327/541 |
| 5,319,601 | 6/1994 | Kawata et al. | 327/143 |
| 5,349,559 | 9/1994 | Park et al. | 327/541 |
| 5,352,935 | 10/1994 | Yamamura et al. | 327/540 |
| 5,359,552 | 10/1994 | Dhong et al. | 327/530 |
| 5,373,226 | 12/1994 | Kimura | 327/541 |

FOREIGN PATENT DOCUMENTS 2256949 12/1992 United Kingdom ..... G05F 3/26

OTHER PUBLICATIONS

Adel Abdel Aziz Ahmed; Band–Gap Voltage References; Technical Notes No. 1228; 3 Jul. 1979; pp. 1–5.

*Primary Examiner*—Terry Cunningham
*Assistant Examiner*—Terry L. Englund
*Attorney, Agent, or Firm*—Cushman Darby & Cushman IP Group of Pillsbury Madison & Sutro LLP

[57] ABSTRACT

Semiconductor integrated circuits, and more particularly an internal power-supply voltage supplier, can be adapted to high density memory devices, for providing a converted external power-supply voltage as an internal power-supply voltage having a desired potential. An internal power-supply voltage supplier receives a reference signal and an internal power-supply voltage signal and provides a semiconductor integrated circuit with an internal power-supply voltage having a desired voltage level by way of a driver, and comprises an offset generator connected to the driver, including two transistors having different width-length characteristics, for receiving the reference signal and the internal power-supply voltage signal and producing an offset corresponding to the received signals, the internal power-supply voltage is provided at a desired voltage level by the driver when the offset generator performs an offset operation.

17 Claims, 3 Drawing Sheets

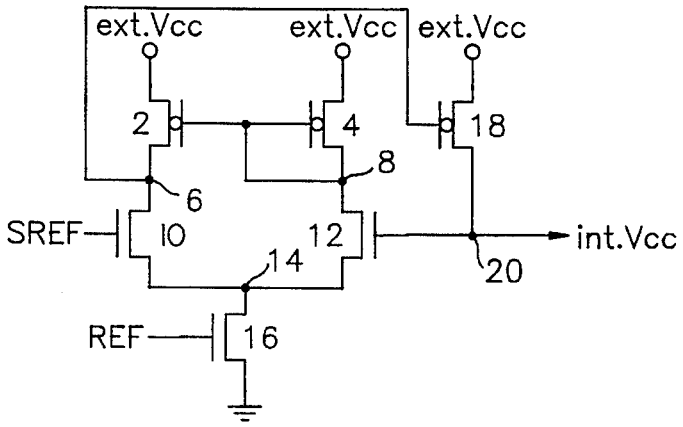
FIG. 1
(CONVENTIONAL ART)
FIG. 2A
(CONVENTIONAL ART)
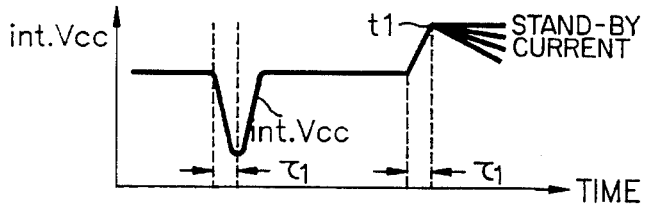
FIG. 2B
(CONVENTIONAL ART)
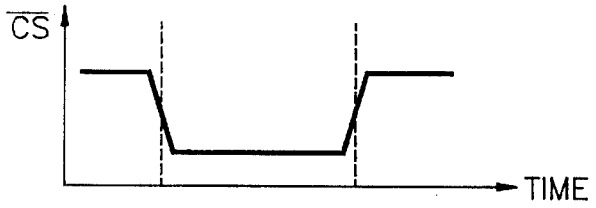
FIG. 2C
(CONVENTIONAL ART)
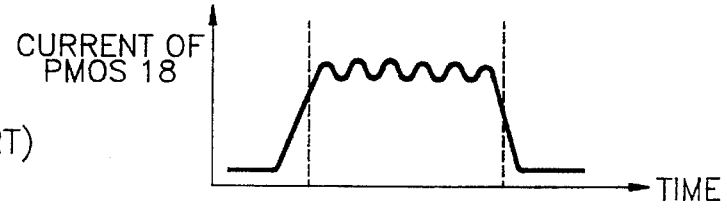
FIG. 2D
(CONVENTIONAL ART)
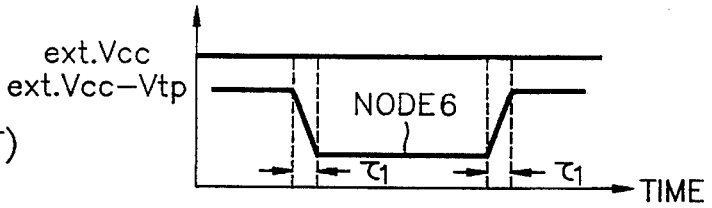

INTERNAL POWER-SUPPLY VOLTAGE SUPPLIER OF SEMICONDUCTOR INTEGRATED CIRCUIT

BACKGROUND OF THE INVENTION

The present invention relates to semiconductor integrated circuits and more particularly to an internal power-supply voltage supplier adapted for high density memory devices, which converts external power-supply voltage into an internal power-supply voltage having a desired potential.

With the rapid progress of the fabrication technologies for semiconductor memory devices, integration has also increased. More specifically, and with reference to the present application, there has been adapted an internal power-supply voltage supplier for ensuring that memory devices fabricated with a narrow line width for each signal path on a chip can have a high reliability and be stabilized for various operational voltages applied thereto. That is, by installing on-chip an internal power-supply voltage supplier, regardless of the external power-supply voltage a constant voltage is applied to the interior of the memory device. It is well known in the art that such an internal voltage drop technique is generally used. However, this technique necessarily includes an internal power driver for receiving an external power-supply voltage and outputting a desired internal power-supply voltage, a reference voltage generator for receiving the external power-supply voltage and generating a reference voltage to determine whether the received voltage is in a desired level, and a detector for detecting whether the internal power-supply voltage output from the internal power driver maintains the desired level. As known from the above described configuration, the internal power-supply voltage supplied to the interior of a chip is provided through the internal power driver, which has to supply an accurate and stable internal power-supply voltage from the application of the external power-supply voltage.

FIG. 1 is a circuit diagram illustrating a conventional internal power-supply voltage supplier. In the overall circuit configuration of the figure, it can be appreciated that there is provided a comparator comprised of differential amplifiers having a level shifting reference signal SREF and the internal power-supply voltage int.Vcc. Signal REF is a reference signal output from the reference voltage generator, for example, such as a band gap reference circuit BGR, which signal is supplied at a constant voltage regardless of an operational voltage and variation of a temperature. The use of BGR circuit techniques are disclosed in Korean patent application No. 91-10193 entitled "A Reference Voltage Generating Circuit", filed by the applicant of the present invention, and in U.S. Pat. No. 4,795,918 issued to Suresh M. Menon. The signal SREF is level-converted from the signal REF to have a higher level than that of the signal REF. That is, since a voltage level of the signal REF is lower than a level of internal power-supply voltage int.Vcc, the signal SREF is made by raising a reference voltage level by a constant ratio.

Operational features of the configuration of FIG. 1 will be described in the following description.

Upon power-up of a chip, the external power-supply voltage ext.Vcc is supplied. By the current flow of an NMOS transistor 10 to which the signal SREF is supplied, a voltage of a connecting node 6 is discharged in the direction of a ground potential GND. Therefrom, a PMOS driver 18 is turned on and a voltage is charged to an internal power node 20 as the output node thereof. When the voltage level charged to the internal power node 20 is raised to a desired level and thus reaches a higher level than that of the signal SREF, the internal power-supply voltage int.Vcc is maintained at the desired level by a switching operation of NMOS transistor 12. In the meanwhile, the configuration of the internal power driver has a feature such that, if the output of the comparator is fed back in the negative direction, the input of the comparator is virtual-shorted (V+=V−, I=0). Accordingly, the voltage of the signal SREF is equal to the internal power-supply voltage int.Vcc and the power flowing into the whole chip is supplied through the PMOS driver 18. Since the size of the PMOS driver 18 driving the whole internal power is large and current levels of differential amplifiers 2,4,10,12 and 16 driving the PMOS driver 18 are relatively low due to the limitation of the stand-by current, an undesirably large period of time is required until a gate control signal applied to the gate of the PMOS driver 18 is varied by a voltage difference between the reference signal SREF and the internal power-supply voltage int.Vcc. Thus, at critical times when the chip operates, the internal power-supply voltage int.Vcc is excessively shaken. For example, supposing that the chip is in a non-selection state, since there is little current flow in the internal power node 20, so that connecting node 6, at the gate of the PMOS driver 18 has a voltage capable of enabling the PMOS driver 18 to be turned off. However, if the chip is changed from the non-selection state to a selection state, the current flow in the internal power node 20 is drastically increased, so that the connecting node 6 can turn on the PMOS driver 18. Since a constant period of time $\tau 1$ is required until current is supplied to the internal power node 20, the level of the internal power-supply voltage int.Vcc goes down during the time $\tau 1$, and thus the chip performance is degraded. On the other hand, if the chip is changed from the selection state to the non-selection state, the voltage level of the connecting node 6 for controlling the current flowed in the PMOS driver 18 suddenly decreases such that abruptly no current flows through the PMOS driver 18 as shown in FIG. 2C. Thus, the level of the internal power-supply voltage int.Vcc during the time $\tau 1$ is kicked-up toward a level of the external power-supply voltage ext.Vcc.

FIGS. 2A to 2D are waveform diagrams illustrating the operational characteristics of the internal power-supply voltage supplier of FIG. 1. Referring to FIG. 2A, it is noted specifically that the level of the internal power-supply voltage at time t1 is kicked-up towards the level of the external power-supply voltage.

In the conventional internal power driver of FIG. 1, it takes a considerable time for the internal power-supply voltage level kicked-up by the above described process to be discharged as a stand-by current. This may also cause a reliability problem since the internal power-supply voltage int.Vcc level of the chip is maintained for a longer time than intended. Furthermore, whether a rising period time of a chip selection signal $\overline{CS}$ is long or short, as illustrated in FIG. 2B, can undesirably cause a change in the internal speed. In addition, in the conventional internal power driver, because gains of the differential amplifiers 2,4,10,12 and 16 are decreased when the level of the external power-supply voltage ext.Vcc is similar to that of the internal power-supply voltage int.Vcc, the period of time $\tau 1$ becomes increased as shown in FIG. 2D. Therefore, the connecting node 6 is biased in the direction that the PMOS driver 18 is always turned on, and the internal power-supply voltage int.Vcc is kicked-up in the direct current curve. FIG. 3 is a waveform diagram showing such a kick-up phenomenon. More particularly, the present inventors have noted that when the external power-supply voltage ext.Vcc level is 3V and the internal power-supply voltage int.Vcc is operated with a level of 3V, more serious problems can be generated. As a result, it has been estimated that the internal power-supply voltage supplier having the conventional internal power driver of FIG. 1 cannot be used dependably as a reliable internal power-supply voltage supplier.

SUMMARY OF THE INVENTION

Therefore, an object of the present invention is to provide an internal power-supply voltage supplier capable of supplying a reliable internal power-supply voltage.

Another object of the present invention is to provide an internal power-supply voltage supplier capable of preventing an internal power-supply voltage from being kicked-up.

Yet another object of the present invention is to provide an internal power-supply voltage supplier capable of preventing operational speed of internal circuits on a chip from being diminished due to variation of an internal power-supply voltage.

Still another object of the present invention is to provide an internal power-supply voltage supplier capable of considerably suppressing a drop or increase of an internal power-supply voltage level occurring when a chip is selected or not selected.

A further object of the present invention is to provide an internal power-supply voltage supplier which has an internal power driver for supplying a stabilized internal power-supply voltage by continuously performing a differential amplifying operation upon power-up of a chip.

To achieve these and other objects of the present invention, there is provided an internal power-supply voltage supplier having an internal power driver for differentially inputting and sensing a reference signal with a voltage level corresponding to an internal power-supply voltage level, and an internal power-supply voltage signal, and then outputting a stabilized internal power-supply voltage.

In accordance with the present invention, the internal power-supply voltage supplier includes an offset generator for generating an offset to the inputs of the reference signal and the internal power-supply voltage by using transistors constituting input means of differential amplifying circuits.

In accordance with the present invention, the internal power-supply voltage supplier further includes a power-up controller for controlling an internal power-supply voltage such that a stabilized internal power-supply voltage can be produced even if, upon power-up of a chip, power is varied.

In accordance with the present invention, the internal power-supply voltage supplier further includes level down shifters for respectively lowering a reference signal with a voltage level corresponding to an internal power-supply voltage level, and an internal power-supply voltage signal, by a predetermined level and respectively receiving the lowered signals to differential amplifying circuits.

BRIEF DESCRIPTION OF THE DRAWINGS

These and other advantages of the present invention may be appreciated from studying the following detailed description of the preferred embodiment together with the drawings in which:

FIG. 1 is a circuit diagram illustrating a conventional internal power-supply voltage supplier;

FIGS. 2A to 2D are waveform diagrams illustrating a voltage characteristic of the internal power-supply voltage supplier of FIG. 1;

DETAILED DESCRIPTION OF THE PREFERRED EMBODIMENTS

Figure 4:
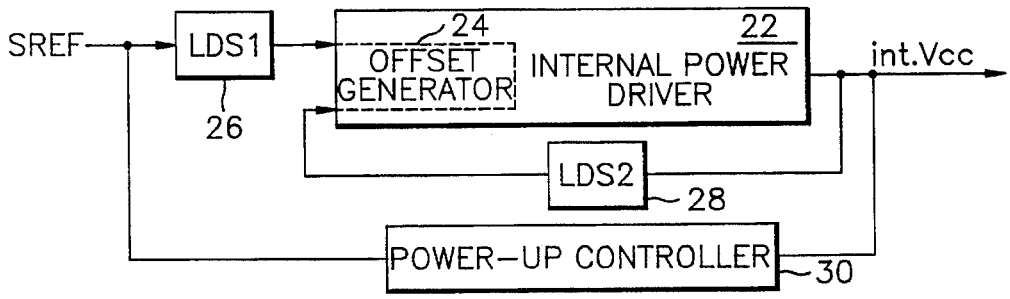
FIG. 4 is a schematic block diagram illustrating a configuration of an internal power-supply voltage supplier according to the present invention.

FIG. 4 is a schematic block diagram illustrating the internal power driver of the internal power-supply voltage supplier according to the present invention. In the figure, the internal power-supply voltage supplier includes a reference signal having a voltage level corresponding to the desired internal power-supply voltage int.Vcc, for comparing to the sensed internal power-supply voltage int.Vcc level, an internal power-supply voltage int.Vcc whose voltage level is reduced by a desired amount below the level from an external power-supply voltage ext.Vcc, a first level down shifter LDS1 26 for receiving the reference signal and reducing its voltage level by a predetermined amount below the external power-supply voltage, a second level down shifter LDS2 28 for receiving the internal power-supply voltage int.Vcc and reducing its voltage level by a predetermined amount, an offset generator 24 for receiving the output signals of the first and second level down shifters 26 and 28 and generating an offset corresponding thereto, an internal power driver 22 for outputting the internal power-supply voltage int.Vcc corresponding to the output of the offset generator 24, and a power-up controller 30 for receiving the reference signal and the internal power-supply voltage int.Vcc, respectively and controlling each voltage level in order to prevent variation of power occurring upon power-up of a chip. In the configuration of FIG. 4, the offset generator 24 is shown as in the internal power driver 22, but the offset generator 24 may be designed to be separate from the internal power driver 22, according to the intention of the designer. Furthermore, the reference signal may be used as the reference signal SREF indicated above. An explanation of the preferred embodiment of the present invention will be hereinafter discussed with reference to FIG. 5.

Figure 5:
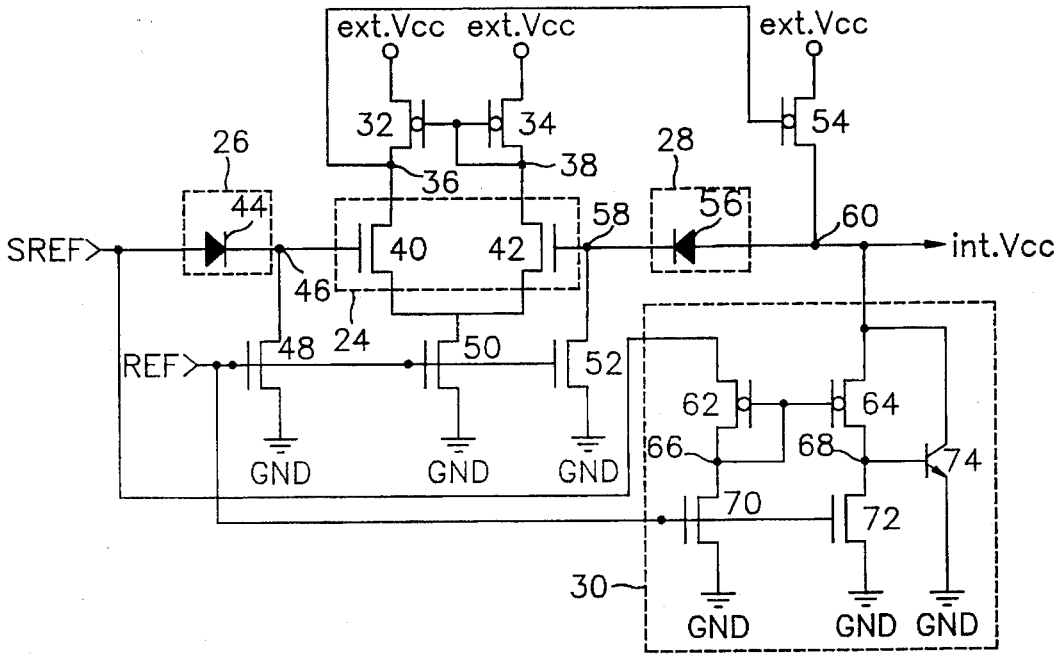
FIG. 5 is a detailed circuit diagram illustrating the configuration of the internal power-supply voltage supplier according to the present invention.

FIG. 5 is a detailed circuit diagram illustrating a construction of the internal power-supply voltage supplier of FIG. 4.

In the figure, ext.Vcc refers to an external power-supply voltage supplied from an external source, and int.Vcc refers to an internal power-supply voltage which is dropped by a desired voltage level below the external power-supply voltage ext.Vcc. REF is a reference signal insensitive to variations of temperature and operating voltage and SREF is a reference signal which is obtained by amplifying the reference signal REF. According to the present invention, the internal power-supply voltage supplier includes a PMOS transistor 32 whose channel is coupled between an external power-supply voltage ext.Vcc and a connecting node 36 and whose gate terminal is coupled to a connecting node 38, a PMOS transistor 34 whose channel is coupled between an external power-supply voltage ext.Vcc and the connecting node 38 and whose gate terminal is coupled to the connecting node 38, an NMOS transistor 40 coupled to the connecting node 36 at the drain terminal thereof, an NMOS transistor 42 coupled to the connecting node 38 at the drain terminal thereof, an NMOS transistor 50 whose channel is coupled between source terminals of the NMOS transistors 40 and 42 and ground potential GND and whose gate terminal is coupled to the reference signal REF, a diode 44 employed as a level down shifter for receiving and reducing the voltage level of the reference signal SREF, and outputting the converted reference signal SREF to a connecting node 46 coupled to the gate of the NMOS transistor 40, and an NMOS transistor 48 whose channel is coupled between the connecting node 46 and a ground potential GND and whose gate terminal is coupled to the reference signal REF. In addition, the internal power-supply voltage supplier includes a PMOS driver 54 whose channel is coupled between an external power-supply voltage ext.Vcc and an internal power node 60 and whose gate terminal is coupled to the connecting node 36, a diode 56 employed as a level down shifter for receiving and level-downing the internal power-supply voltage int.Vcc, and outputting the level-downed voltage to a connecting node 58 coupled to the gate of the NMOS transistor 42, an NMOS transistor 52 whose channel is coupled between the connecting node 58 and a ground potential GND and whose gate terminal is coupled to the reference signal REF, a PMOS transistor 62 having a source terminal to which the reference signal SREF inputs and drain and gate terminals commonly connected to a connecting node 66, a PMOS transistor 64 having a source terminal receiving the internal power-supply voltage int.Vcc, a gate terminal coupled to the connecting node 66, and a drain terminal coupled to a connecting node 68, an NMOS transistor 70 whose channel is coupled between the connecting node 66 and a ground potential GND and whose gate terminal is coupled to the reference signal REF, an NMOS transistor 72 whose channel is coupled between the connecting node 68 and a ground potential GND and whose gate terminal is coupled to the reference signal REF, and an NPN type bipolar transistor 74 whose current path is coupled between the internal power node 60 and a ground potential GND and whose base terminal is coupled to the connecting node 68. By contrast with the configuration of FIG. 4, the internal power-supply voltage supplier, as shown in dotted blocks of FIG. 5, includes the diode 44 corresponding to the first level down shifter LDS1 26 of FIG. 4, the diode 56 corresponding to the second level down shifter LSD2 28 of FIG. 4, a circuit comprised of reference numerals 62, 64, 70, 72 and 74 corresponding to the power-up controller 30 of FIG. 4, and the NMOS transistors 40 and 42 corresponding to the offset generator 24 of FIG. 4. Under this construction, the offset generator 24 is comprised to include the NMOS transistor 40 and 42, but it may be comprised to further include the NMOS transistor 50, in addition thereto. In fact, however, the dotted block of FIG. 5 can be indicated as shown because circuit components for substantially generating the offset are made up of the NMOS transistors 40 and 42.

Figure 3:
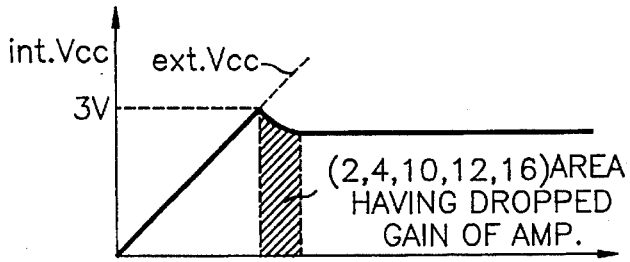
FIG. 3 (CONVENTIONAL ART)
FIG. 3 is a waveform diagram illustrating an internal power-supply voltage level in the direct current curve of the conventional internal power-supply voltage supplier.
Figure 6:
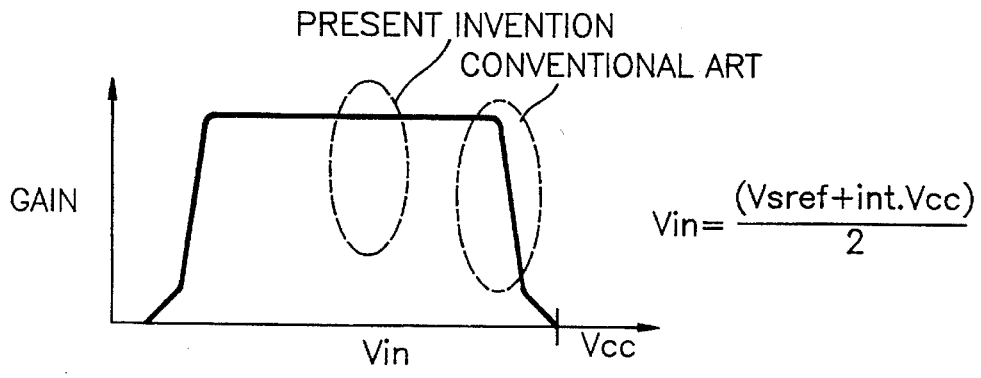
FIG. 6 is a waveform diagram illustrating an operational range of the differential amplifiers when used with the level down shifters constructed according to the present invention.
Figure 7:
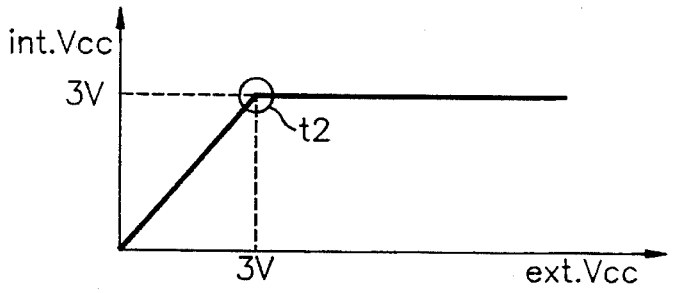
FIG. 7 is a waveform diagram illustrating the internal power-supply voltage level in the direct current curve of the internal power-supply voltage supplier constructed according to the present invention.

As one of characteristics of the configuration of FIG. 5, when the levels of the internal power-supply voltage int.Vcc and the reference signal SREF are similar to the external power-supply voltage ext.Vcc level, the sensitivity of the differential amplifiers 32, 34, 40, 42, and 50 is reduced, whereby the overall operational speed of the internal circuit is diminished. To prevent this drawback, the level down shifter is used, so that the NMOS transistors 40 and 42 compare voltages applied to the connecting nodes 46 and 58 having an intermediate level below the external power-supply voltage ext.Vcc. Thereby, in the direct current state that the level of the internal power-supply voltage int.Vcc approximately equals that of the external power-supply voltage ext.Vcc, a kick-up phenomenon of the internal power-supply voltage int.Vcc can be prevented. The constant gain region of the differential amplifiers 32, 34, 40, 42, and 50 of FIG. 5 is indicated in FIG. 6. Furthermore, it can be appreciated that a kick-up phenomenon illustrated in FIG. 3 is prevented, as shown in the waveform diagrams of FIG. 7. Furthermore, the internal power-supply voltage supplier according to the present invention also includes the offset generator 24 to prevent the internal voltage level of the power-supply voltage int.Vcc from fluctuating upon chip selection/non-selection. In the preferred embodiment of the present invention, to implement the offset generator 24, the size of the NMOS transistor 42 is chosen to be smaller than that of the NMOS transistor 40, thereby forming an input offset to the differential amplifiers 32, 34, 40, 42, and 50. According to the actual numerical values used by the inventors, the width/length W/L ratio of the NMOS transistor 40 is applied as 20/1, and the width/length W/L ratio of the NMOS transistor 42 is applied as 15/1. In addition, when the offset generator 24 of the present invention is used together with the power-up controller 30, the offset generator 24 can have a maximum effect. According to the operation of the power-up controller 30, if a voltage higher than that of the reference signal SREF is applied to the internal power-supply voltage int.Vcc, the PMOS transistor 64 is turned on and a base current of the bipolar transistor 74 flows. Since the base current receives its collector current from the internal power node 60, the internal power-supply voltage int.Vcc level is lowered to the reference signal SREF level. By this operation of the internal power-supply voltage supplier, a power-down operation can be smoothly performed upon a bumping test of the power line. Meanwhile, in the power-up controller 30, if the size of the PMOS transistors 62 and 64 or the NMOS transistors 70 and 72 is adjusted, the sensing voltage difference between the internal power-supply voltage int.Vcc and the reference signal SREF is maintained within the range between 0.1 to 0.3 volts. Further, to prevent the voltage level of the internal power-supply voltage int.Vcc from fluctuating during chip selection, the differential amplifiers 32, 34, 40, 42, and 50 are kept in an active state such that a constant current always flows in the internal power node 60.

Figure 8:
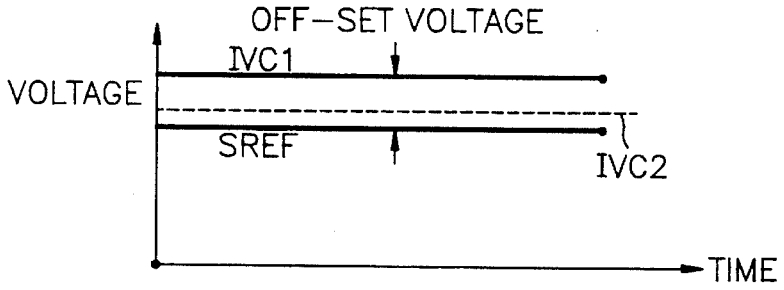
FIG. 8 is a waveform diagram illustrating variation of the internal power-supply voltage level by operation of an offset generator and a power-up controller constructed according to the present invention.
Figure 9:
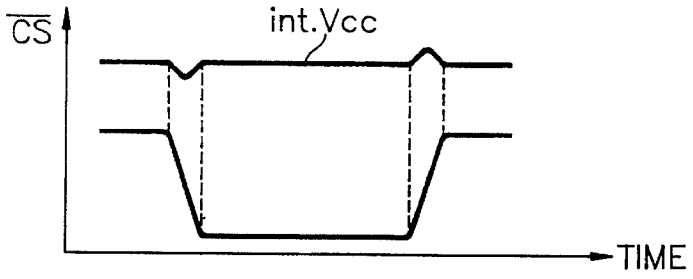
FIG. 9 is a waveform diagram illustrating variation of the internal power-supply voltage level of the internal power-supply voltage supplier according to the present invention, upon selection or non-selection of a chip.

Meanwhile, FIG. 8 shows variation of the internal power-supply voltage int.Vcc occurring on the basis of the above described operation. That is, the internal power-supply voltage int.Vcc level increases to level IVC1 by the amount of offset caused by the offset generator 24. The power-up controller 30 senses the increased internal power-supply voltage int.Vcc level and then reduces the increased int.Vcc level to an IVC2 level. In this process, even though in a ready state, the internal power driver 22 continuously operates in an active state. In other words, the internal power driver 22 is insensitive to the selection and non-selection of a chip, so that an internal power-supply voltage int.Vcc having a stable alternating current AC characteristic can be obtained, as shown in FIG. 9.

The internal power-supply voltage supplier of FIG. 5 implemented on the basis of the configuration of FIG. 4 is a preferred embodiment where the technical idea of the present invention is realized in an optimum state. In the configuration of FIG. 5, it is apparent to one skilled in the art that different modifications may be constructed, depending upon signal logic and device characteristics. Also, the waveform diagrams shown in FIGS. 6 to 9 may vary according to the level of the power-supply voltage, but the waveform characteristic will still be similar to the above waveforms. The waveform diagrams illustrated in FIGS. 6 to 9 are results of simulations by the inventors.

As can be appreciated from the foregoing, the internal power-supply voltage supplier of this invention derives its advantages by generating an offset based on the difference between a reference signal and an internal power-supply voltage int.Vcc and by protecting the internal power-supply voltage int.Vcc from being kicked-up by including a power-up controller. Moreover, the internal power-supply voltage supplier of this invention has advantages such as protecting the operation speed of the internal circuits from variations of the internal power-supply voltage, and suppressing fluctuations in internal power-supply voltage level upon selection and non-selection of a chip. Accordingly, internal power-supply voltage supplier can supply a stabilized internal power-supply voltage by continuously performing a differential amplifying operation during power-up of the chip.

What is claimed is:

1. An internal power-supply voltage supplier comprising:

a driver having an external input terminal coupled to an external power supply, a control input terminal and an output terminal, said driver providing to said output terminal an internal power-supply voltage having a desired internal voltage level;

an offset generator having an output connected to said control input terminal of said driver, said offset generator receiving a reference voltage and said internal power-supply voltage and outputting to said offset generator output an offset corresponding to a difference in voltage levels between said reference voltage and said internal power-supply voltage, said offset generator using two differentially connected transistors having different channel widths to ensure that said offset is produced when said difference is minimal; and a power-up controller which receives said reference voltage and said internal power-supply voltage and reduces the voltage level of said internal power-supply voltage when said internal power-supply voltage exceeds said reference voltage by a predetermined voltage level.

2. The internal power-supply voltage supplier as claimed in claim 1, wherein:

said two differentially connected transistors of said offset generator are first and second NMOS transistors, said first NMOS transistor being controlled by said reference voltage, said second NMOS transistor being controlled by said internal power-supply voltage, said first NMOS transistor having a channel width greater than that of said second NMOS transistor, and wherein said driver is a transistor.

3. The internal power-supply voltage supplier as claimed in claim 2, wherein the channel of said first NMOS transistor has a width-length ratio of approximately 20 and the channel of said second NMOS transistor has a width-length ratio of approximately 15.

4. An internal power-supply voltage supplier of a semiconductor integrated circuit comprising:

a driver having an external input terminal coupled to an external power supply voltage, a control input terminal and an output terminal, said driver providing to said output terminal an internal power-supply voltage having a desired internal voltage level;

a first level down shifter for receiving a reference voltage and reducing said reference voltage by a first predetermined amount to a first voltage level below said external power-supply voltage;

a second level down shifter for receiving said internal power-supply voltage and reducing said internal power-supply voltage by a second predetermined amount to a second voltage level below said external power-supply voltage;

an offset generator having input terminals receiving said first and second voltage levels and having an output coupled to said control input terminal of said driver, said offset generator outputting to said offset generator output an offset corresponding to a difference between said first and second voltage levels, said offset generator using two differentially connected transistors having different channel widths to ensure that said offset is produced when said difference is minimal; and a power-up controller which receives said reference voltage and said internal power-supply voltage and reduces the voltage level of said internal power-supply voltage when said internal power-supply voltage exceeds said reference voltage by a predetermined voltage level.

5. The internal power-supply voltage supplier as claimed in claim 4, wherein each of said first and second level down shifters is comprised of a diode.

6. The internal power-supply voltage supplier as claimed in claim 5, wherein said two differentially connected transistors of said offset generator are first and second NMOS transistors, said first NMOS transistor being controlled by said first voltage level, said second NMOS transistor being controlled by said second voltage level, said first NMOS transistor having a channel width greater than that of said second NMOS transistor.

7. The internal power-supply voltage supplier as claimed in claim 6, wherein the channel of said first NMOS transistor has a width-length ratio of approximately 20 and the channel of said second NMOS transistor has a width-length ratio of approximately 15.

8. An internal power-supply voltage supplier of a semiconductor integrated circuit comprising:

a driver having an external input terminal coupled to an external power-supply voltage, a control input terminal and an output terminal, said driver providing to said output terminal an internal power-supply voltage having a desired internal voltage level;

an offset generator having an output connected to said control input terminal of said driver, said offset generator receiving a reference voltage and said internal power-supply voltage and outputting to said offset generator output an offset corresponding to a difference in voltage levels between said reference voltage and said internal power-supply voltage, said offset generator using first and second differentially connected transistors having different channel widths to ensure that said offset is produced when said difference is minimal; and a power-up controller for receiving said reference voltage and said internal power-supply voltage and reducing the voltage level of said internal power-supply voltage when said internal power-supply voltage exceeds said reference voltage by a predetermined voltage level.

9. The internal power-supply voltage supplier as claimed in claim 8, further comprising:

a first level down shifter for receiving said reference voltage and reducing said reference voltage by a first predetermined amount to a first voltage level below said external power-supply voltage and having an output connected to said first differentially connected transistor of said offset generator; and a second level down shifter for receiving said internal power-supply voltage and reducing said internal power-supply voltage by a second predetermined amount to a second voltage level below said external power-supply voltage and having an output connected to said second differentially connected transistor of said offset generator.

10. The internal power-supply voltage supplier as claimed in claim 9, wherein each of said first and second level down shifters is comprised of a diode.

11. The internal power-supply voltage supplier as claimed in claim 10, wherein each of said first and second differentially connected transistors is comprised of an NMOS transistor, said first differentially connected transistor having a current driving ability greater than that of said second differentially connected transistor.

12. The internal power-supply voltage supplier as claimed in claim 11, wherein the channel of said first transistor has a width-length ratio of approximately 20 and the channel of said second transistor has a width-length ratio of approximately 15.

13. An internal power-supply voltage supplier of a semiconductor integrated circuit which inputs a reference voltage having a voltage level corresponding to a desired voltage level comprising:

a first level down shifter for receiving said reference voltage and for reducing said reference voltage by a first predetermined amount to a first voltage level below an external power-supply voltage;

a second level down shifter for receiving an internal power-supply voltage and reducing said internal power-supply voltage by a second predetermined amount to a second voltage level below said external power-supply voltage;

an offset generator for receiving said first and second voltage levels and generating an offset corresponding to a difference therebetween, said offset generator using two differentially connected transistors having different channel widths to generate said offset when said difference is minimal;

an internal power driver for outputting said internal power-supply voltage having an output voltage level substantially at said desired voltage level, said internal power driver being controlled by said offset; and a power-up controller for receiving said reference voltage and said internal power-supply voltage and controlling the voltage level of said reference voltage and the voltage level of said internal power-supply voltage in order to prevent variation of said internal power-supply voltage from occurring upon power-up of a chip.

14. The internal power-supply voltage supplier as claimed in claim 13, wherein each of said first and second level down shifters is comprised of a diode.

15. The internal power-supply voltage supplier as claimed in claim 14, wherein said two differentially connected transistors of said offset generator are first and second NMOS transistors, said first NMOS transistor being controlled by said first voltage level, said second NMOS transistor being controlled by said second voltage level, said first NMOS transistor having a channel width greater than that of said second-NMOS transistor.

16. The internal power-supply voltage supplier as claimed in claim 14, wherein said power-up controller comprises:

a first PMOS transistor for receiving said reference voltage at a source thereof and having a gate and a drain coupled commonly to each other;

a first NMOS transistor having a first channel formed between the drain of said first PMOS transistor and a ground potential, and switching-controlled by a second reference voltage;

a second PMOS transistor for receiving said internal power-supply voltage at a source thereof and having a gate coupled commonly to the gate of said first PMOS transistor;

a second NMOS transistor having a second channel formed between the drain of said second PMOS transistor and said ground potential, and switching-controlled by said second reference voltage; and a bipolar transistor having a third channel formed between the source of said second PMOS transistor and said ground potential, and switching-controlled by a voltage applied to the drain of said second PMOS transistor.

17. The internal power-supply voltage supplier as claimed in claim 15, wherein the channel of said first NMOS transistor has a width-length ratio of approximately 20 and the channel of said second NMOS transistor has a width-length ratio of approximately 15.

* * * * *